United States Patent [19]

Stayner

[11] Patent Number: 4,466,909

[45] Date of Patent: Aug. 21, 1984

[54] OIL-IN-WATER MICROEMULSION FLUID

[75] Inventor: Robert A. Stayner, Lafayette, Calif.

[73] Assignee: Chevron Research Company, San Francisco, Calif.

[21] Appl. No.: 191,589

[22] Filed: Sep. 29, 1980

[51] Int. Cl.[3] ..... C10M 1/06

[52] U.S. Cl. ..... 252/49.5; 252/32.7 E

[58] Field of Search ..... 252/49.5, 32.7 E, 25

[56] References Cited

U.S. PATENT DOCUMENTS

| | | | |
|---|---|---|---|
| 2,993,857 | 7/1961 | Sudholz | 252/49.5 |
| 3,108,070 | 10/1963 | Hartung et al. | 252/32.7 E |
| 3,255,108 | 6/1966 | Wiese | 252/32.7 E |
| 3,269,946 | 8/1966 | Wiese | 252/49.5 X |
| 3,281,356 | 10/1966 | Coleman | 252/32.7 E |
| 4,257,902 | 3/1981 | Singer | 252/25 X |

FOREIGN PATENT DOCUMENTS

| | | | |
|---|---|---|---|
| 739484 | 11/1955 | United Kingdom | 252/49.5 |
| 802941 | 10/1958 | United Kingdom | 252/49.5 |
| 816267 | 7/1959 | United Kingdom | 252/49.5 |

*Primary Examiner*—Andrew Metz

*Attorney, Agent, or Firm*—J. A. Buchanan, Jr.; D. A. Newell; J. J. DeYoung

[57] ABSTRACT

Disclosed is an oil-in-water micro-emulsion comprising 0.09 to 49.99 percent by mass oil, 50 to 99.9 percent by mass of water, and 0.01 to 10 mass percent of an antiwear agent.

3 Claims, No Drawings

OIL-IN-WATER MICROEMULSION FLUID

FIELD OF THE INVENTION

The invention relates to an aqueous micro-emulsion, more particularly an oil-in-water micro-emulsion.

BACKGROUND OF THE INVENTION

Micro-emulsions are transparent or translucent systems consisting of two immiscible liquids, one being dispersed in the other. The dispersed, discontinuous, or internal phase is the liquid that is broken up into droplets of less than about 2000 Angstroms. The surrounding liquid is known as the continuous or external phase.

Aqueous based lubricants and functional fluids have been greatly in demand not only because of their low cost, but also because of their ease of disposal, reduced dependence on supply of petroleum-derived base fluid, and their fire resistance.

Antiwear compounds are well known in the art for their use in conventional oil-based lubricants. For example, numerous metal-based additives are disclosed in the book "Metal-Based Lubricant Compositions", by Henry M. Drew, Noyes Data Corporation, Chemical Technology Review No. 48 (1975).

SUMMARY OF THE INVENTION

Disclosed is an oil-in-water micro-emulsion comprising 0.09 to 49.99 percent by mass of oil, 50 to 99.9 percent by mass of water, and 0.01 to 10 mass percent of an antiwear agent. In a further embodiment of the present invention, from 0.01 to 10 mass percent of a water soluble antiwear agent may also be employed. Another embodiment comprises the inclusion of a stable dispersion of a finely divided solid lubricant.

DETAILED DESCRIPTION OF THE INVENTION

The micro-emulsion of the present invention is useful as a functional fluid or aqueous-type lubricant particularly as a hydraulic fluid, soluble cutting oil, die casting lubricant, stamping fluid, rust preventive coating, and in other similar applications.

The micro-emulsion contains water, oil, and at least one oil soluble antiwear agent and a surfactant/cosurfactant to prevent the separation of the components into various phases.

The oil-in-water micro-emulsion of the present invention comprises from about 50 to 99.9, preferably 70 to 99 and more preferably 90 to 99 weight percent water, 0.09 to 49.99, preferably 0.9 to 10 and more preferably 0.9 to 5 weight percent oil; and 0.01 to 10, preferably 0.1 to 5, and more preferably 0.1 to 3 weight percent of an oil soluble antiwear agent. The above percentage for oil includes the surfactant/cosurfactant necessary to form the stable micro-emulsion.

Suitable oils include both natural and synthetic oil. Preferred are the mineral oils and fractions thereof. Particularly preferred are the lower viscosity mineral oils having viscosities ranging from about 10 CST (centistoke) at 40° C. to about 100 CST at 40° C. Also preferred are mineral oil fractions of naphthenic based stocks because of their ease of emulsification as compared to paraffinic based stocks which are more difficult to emulsify. Suitable synthetic oils include the diesters, alkyl benzenes, polyalphaolefins, polyethers and the like.

The amount of oil incorporated into the compositions of the present invention is fixed by two considerations. First, sufficient oil is used to dissolve the antiwear agent and produce a liquid solution that is mobile and capable of being emulsified. Typically, this solution has a viscosity in the range of 100 to 500 CST at 40° C. Secondly, sufficient oil must be used to give rheopetic properties to the resulting micro-emulsion. It has been found that as compared to conventional soluble oil emulsions, the microemulsions of the present invention exhibit increased volumetric pumping efficiency.

The antiwear agents useful in the compositions of the present invention are any of the oil soluble or oil dispersable antiwear agents known in the lubricating oil art. Particularly preferred are the well known oil-soluble metal-containing antiwear agents. These include the metal dialkyldithiophosphates, the metal dithiocarbamates, metal carboxylates and thio-carboxylates, etc. The metal portion of the antiwear agent may be any of a broad range of metals, including the alkaline earth metals, such as calcium, magnesium and strontium, the Group III-A metals such as aluminum, the Group IV-A metals such as tin and lead, the Group V-A metals such as antimony and bismuth, the Group II-B metals such as zinc and cadmium, the Group VI-B metals such as chromium, molybdenum, and tungsten, the Group VIII metals such as nickel and cobalt. The preferred compounds are the zinc dialkyldithiophosphates.

Frequently, zinc dialkyldithiophosphates are prepared as an oil solution. This form is preferred for the present invention.

When the antiwear agent is a solid or a very viscous liquid, it is first dissolved in the oil before a micro-emulsion is made.

In addition to the oil soluble antiwear agent, water soluble agents are also contemplated in this invention. These agents include the polyhydroxy organic compounds such as glycerine, sugar, sorbitan, monostearate, pentaerythritol monocleate, and the like; also included are the hydroxy esters of phosphoric acid such as hexa-2-hydroxyethylphosphoramide, other amine phosphates, and compounds such as urea. The preferred water soluble antiwear agent is urea. These optional ingredients will be used in concentrations of 0.01 to 10%, preferably from 0.2 to 2% based on total weight.

In a further option embodiment of the present invention, the inclusion of stable dispersions of finely divided solid lubricants is contemplated, such as zinc sulfide, molybdenum disulfide, teflon, wax, graphite, polyethylene, and the like. Such optional ingredients will be present in 0.01 to 10% preferably 0.2 to 2% based on total weight.

To form the micro-emulsion and in order to prevent the separation of the emulsion into separate phases, the use of a surfactant/cosurfactant system is necessary. The various types of micro-emulsions and their formation from water, an "oil", surfactant and cosurfactant are described in the book, "Micro-emulsions: Theory and Practice," edited by L. N. Prince, and published by Academic Press, Inc., 1977,. Briefly, a primary water-soluble surfactant is required to give micro-emulsions. Suitable surfactants include the anionic, nonionic, cationic and amphoteric surfactants which are well known in the art, see for example, Kirk-Othmer, Encyclopedia of Chemical Technology, Second Edition, Volume 19, pages 507–509, the entire disclosure of which is incorporated herein by reference. The primary surfactants of the surfactant/cosurfactant system has a high Hydrophile-Lipophile (HLB) value preferably in excess of 10 and usually in the range of 10 to 40. The cosurfactant has a lower HLB value than the primary surfactant, and it may go as low as 4 or 5. However, it is preferred that the cosurfactant HLB value be nearly equal to that of the primary surfactant.

The anionic surfactants include both acids and salts and are categorized as carboxylates, sulfates, sulfonates, and the phosphate esters. The carboxylates are naphthenates or aliphatic compounds having one or more carboxylic acid (COOH) group in the molecule. Among the useful carboxylates are the fatty acids, rosin, tall oil, and various naphthenic acids having from 8 to 30 carbon atoms.

The sulfate emulsifiers are mono-esters of sulfuric acid and an aliphatic alcohol. Preferably, the alkyl group has from 10 to 100 carbon atoms in essentially linear arrangement. Another class of sulfates are the mono-esters of sulfuric acid and an ethoxylated alcohol. In this class, the alkyl group is from 10 to 100 carbons in extent and the number of ethylene glycol units ranges from 1 to 10.

The sulfonate emulsifiers include both aliphatic and alkyl substituted aromatic sulfonates. Aliphatic sulfonates have from 10 to 100 carbon atoms in essentially linear arrangement with one or more sulfonic acid group ($SO_3H$) attached thereto. Preferably, this acid group is near the end of the carbon chain. The alkyl substituted aromatic sulfonates comprise a sulfonated benzene or naphthalene molecule having one or more alkyl groups of 1 to 50 carbon atoms each, attached to the aromatic ring. One convenient source of sulfonates is the sulfonation of aromatics contained in various petroleum fractions obtained in the refinery of crude oil.

The phosphate esters are mono- or di-esters of phosphoric acid and an alcohol. The total number of carbon atoms in the alkyl groups of these esters is in the range of 10 to 100.

In all of the above anionic surfactants the useful salts are alkali metal salts, the ammonium salt, or the amine salts. The amine salts are formed from low molecular weight amines such as morpholine, triethanol amine, and the like. Preferably, the salt is the sodium salt.

The nonionic surfactants do not ionize in solution and are compatible with either anionic or cationic surfactants. The simplest nonionics are alcohols, amides, and hydroxy alkyl esters having an essentially linear 10 to 30 carbon aliphatic backbone. Examples include cetyl alcohol, fatty acid alkanol amides, etc. However, the most common type of nonionic surfactant is that formed by ethoxylating an alcohol, an alkylphenol, a carboxylic acid, or carboxylic amide with ethylene oxide. In each of these cases, the hydrophilic portion of the surfactant is either $\beta$-hydroxy ethyl or a polyether of ethylene glycol. The hydrophilic portion is an alkyl or alkylaryl group of 10 to 100 carbon atoms.

The cationic surfactants are generally amine hydrochlorides or the salts of quaternary amines. These amines usually have one long carbon chain, and 2 or 3 short chains. The amines useful to form these cationic surfactants have from 10 to 100 carbon atoms, preferably with 8 to 98 of the carbon atoms in one alkyl group or one alkylsubstituted arylmethyl group.

Other types of useful cationic surfactants include the imidazolines, oxygen-containing amines and the like.

For the present invention, the preferred primary surfactants are the sodium sulfonates of alkylbenzene or sodium naphthenates.

For the preparation of micro-emulsions, a cosurfactant is usually required. The cosurfactant is more soluble in the "oil" than is the primary surfactant. Such solubility comparisons are frequently based on the HLB values of the surfactant and cosurfactant. Although cosurfactants may have the same chemical structures as previously defined for the primary surfactants, they are preferably alcohols or non-ionic compounds.

The quantity of the surfactant system necessary to form a stable micro-emulsion which will not separate into separate phases with prolonged storage may vary greatly with the type of surfactant/cosurfactant system. In general, this system will comprise from 0.5 to 25 mass percent of the micro-emulsion, preferably 1 to 15 percent, more preferably 2 to 10 percent. It is preferred to use enough of the surfactant/cosurfactant system, so as to readily form a micro-emulsion. The ratio of surfactant to cosurfactant will usually vary from 10:1 to 1:1 by weight, preferably from 6:1 to 2:1.

The micro-emulsion may also contain additional additives, if desired, for the particular service contemplated. Other additives that may be present in the micro-emulsion of the present invention include rust inhibitors, corrosion inhibitors, metal deactivators, bactericides, antifoam agents, etc.

EXAMPLES

EXAMPLES 1-12—HIGH PRESSURE PUMP TEST

Various test compositions were tested in a high-pressure vane pump test for measuring the wear characteristics of hydraulic fluids. Test procedure ASTM D 2882 was utilized except that the fluid was circulated for 20 hours at 1000 psi, and at a temperature of 120° F. Steel weight losses on the vanes, ring and rotor were measured at the end of each test along with the weight loss of the bronze bushings. In addition, flow rates were determined.

Various compositions were prepared and tested by the above procedure. The results are given in Table I (below). Unless otherwise specified, the test compositions were prepared from a neutral pale oil having a viscosity of 20 CST at 40° C.; a primary surfactant comprising a 50% solution in oil of a mixture of sodium sulfonate, sodium naphthenate, ethanolamine sulfonate, ethanolamine naphthenate and hexylene glycol. A cosurfactant comprising fatty acid diethanolamide (Hostaeor DT); a vapor phase corrosion inhibitor (morpholine); a silicone antifoaming agent (GE Antifoam 60) and a zinc di(2-ethylhexyl)dithiophoshate as the antiwear agent.

TABLE I

| | HIGH PRESSURE PUMP TEST | | | | | | | | | | | |
|---|---|---|---|---|---|---|---|---|---|---|---|---|
| | 1 | 2 | 3 | 4 | 5 | 6 | 7(1) | 8(2) | 9(3) | 10(4) | 11(5) | 12(6) |
| Test Composition (Mass %) | | | | | | | | | | | | |
| Water | 80.0 | 92.5 | 93.0 | 89.5 | 80.0 | 87.0 | 86.0 | 91.5 | 89.0 | 89.5 | 88.5 | 91.0 |
| Oil | 7.6 | 1.0 | 1.0 | 1.0 | 4.0 | 4.0 | 4.0 | 0.0 | 1.0 | 1.0 | 1.0 | 0.0 |
| Primary | 11.4 | 5.0 | 4.0 | 5.0 | 13.0 | 6.0 | 6.0 | 4.0 | 5.0 | 5.0 | 5.0 | 4.0 |

TABLE I-continued

| | HIGH PRESSURE PUMP TEST | | | | | | | | | | | |
|---|---|---|---|---|---|---|---|---|---|---|---|---|
| | 1 | 2 | 3 | 4 | 5 | 6 | 7(1) | 8(2) | 9(3) | 10(4) | 11(5) | 12(6) |
| Surfactant | | | | | | | | | | | | |
| Cosurfactant | 1.0 | 1.5 | 1.0 | 1.5 | 2.0 | 2.0 | 2.0 | 1.5 | 1.5 | 1.5 | 1.5 | 2.0 |
| Antiwear Agent | | | | | | | | | | | | |
| Oil soluble | 0 | 0 | 1.0 | 3.0 | 1.0 | 1.0 | 1.0 | 1.0 | 3.0 | 3.0 | 3.0 | 1.0 |
| Water soluble | 0 | 0 | 0 | 0 | 0 | 0 | 0 | 0 | 0 | 0 | 1.0 | 0 |
| Results (Wt. loss, mg.) | | | | | | | | | | | | |
| Vanes | 56 | 30 | 10 | 11 | 18 | 11 | 23 | 22 | 14 | 211 | 18 | 11 |
| Rotor | 83 | 97 | 64 | 74 | 109 | 82 | 97 | 70 | 110 | 1258 | 70 | 24 |
| Ring | 1220 | 1414 | 500 | 450 | 1143 | 626 | 532 | 486 | 434 | 8780 | 386 | 716 |
| Total | 1359 | 1541 | 574 | 535 | 1270 | 710 | 652 | 578 | 558 | 10249 | 454 | 752 |
| Bronze Bushing | 55 | 82 | 94 | 146 | 35 | 86 | 100 | 108 | 108 | 993 | 104 | 172 |
| Flow Rate, gpm | | | | | | | | | | | | |
| Start | 4.6 | 4.7 | 4.5 | 3.9 | 5.3 | 4.9 | 3.7 | 3.5 | 3.4 | 3.9 | 2.0(7) | 4.8 |
| Finish | 3.2 | 4.5 | 5.1 | 2.9 | 5.1 | 3.1 | 3.1 | 2.9 | 2.6 | 1.0 | 1.6 | 2.3 |

(1)Also contains 0.1% of ethylene diamine tetra-acetic acid.
(2)Also contains 2.0% of a non-ionic (Polykol B11/50) manufactured by American Hoechst Corporation.
(3)The pale oil was replaced by Cit Con bright stock, viscosity of 31 cs at 100° C.
(4)This run continued for 500 hours at a pump pressure of 800 psi.
(5)Also contains 1.0% urea.
(6)The sulfonate primary surfactant was replaced by a 4:1 mixture of a monylphenol/ethylene oxide non-ionic:anionic phosphate ester.
(7)Low flow rate attributed to worn pump housing.

What is claimed is:

1. An oil-in-water micro-emulsion fluid consisting essentially of:

(a) 0.09 to 49.99 percent by mass of oil and a surfactant/cosurfactant which inhibits the separation of the micro-emulsion into separate phases;

(b) 50 to 99.9 percent by mass water;

(c) 0.01 to 10 percent by mass of an oil soluble metal containing antiwear agent selected from the metal dialkyldithiophosphates, metal dithiocarbamates, metal carboxylates and thiocarboxylates; and (d) 0.01 to 10 percent by mass of urea.

2. The micro-emulsion fluid of claim 1 wherein said oil soluble metal compound is a zinc dialkyldithiophosphate.

3. The oil-in-water micro-emulsion fluid of claim 2 wherein:

(a) 0.9 to 10 mass percent of said fluid is said oil and surfactant/cosurfactant;

(b) 70 to 99 mass percent of said fluid is water;

(c) 0.1 to 5.0 mass percent of said fluid is a zinc dialkyldithiophosphate; and (d) 0.2 to 2.0 mass percent urea.

* * * * *